US005498219A

United States Patent [19]

Soufi

[11] Patent Number: 5,498,219

[45] Date of Patent: Mar. 12, 1996

[54] INFANT WALKING TRAINER

[76] Inventor: Abdoull K. Soufi, 30-61 82nd St., East Elmhurst, N.Y. 11370-1916

[21] Appl. No.: 292,570

[22] Filed: Aug. 18, 1994

[51] Int. Cl.[6] ..... A63B 22/00

[52] U.S. Cl. ..... 482/69; 482/43; 434/255

[58] Field of Search ..... 482/69, 48; 434/247, 434/250, 255, 258

[56] References Cited

U.S. PATENT DOCUMENTS

| | | | |
|---|---|---|---|
| 1,193,374 | 8/1916 | Gillian | 482/69 |
| 4,431,184 | 2/1984 | Lew et al. | 482/43 |
| 4,922,860 | 5/1990 | Hutchings | 482/69 |
| 5,120,287 | 6/1992 | Brown et al. | 482/69 |
| 5,356,355 | 10/1994 | Campbell | 482/69 |

*Primary Examiner*—Lynne A. Reichard
*Attorney, Agent, or Firm*—Kirschstein, et al.

[57] ABSTRACT

An infant walking trainer includes a handle and a body harness suspended from the handle. The harness supports an infant in an upright walking stance when the handle is held overhead the infant.

1 Claim, 2 Drawing Sheets

2
18
16
12
14
82
80
90
88
86
84
22
10
110
108
20
2
74
72
78
94
98
76
100
66
102
54
52
50
92
106
96
104
70
68
46
64
62
28
48
60
58
32
30
40
44
24
56
42
26
38
34
36

INFANT WALKING TRAINER

BACKGROUND OF THE INVENTION

FIELD OF THE INVENTION

This invention generally relates to an accessory for training infants to walk.

DESCRIPTION OF THE RELATED ART

Infants learning to walk are often seated in wheeled walkers. When the infants stand up in such walkers and throw their weight in a given direction, the walkers are propelled in that direction, thereby simulating walking. Experience has shown, however, that such wheeled walkers do not realistically simulate walking. Worse than that, they have proven to be safety hazards. Many infants have been injured when such walkers have been propelled, often uncontrollably, down staircases.

SUMMARY OF THE INVENTION

OBJECTS OF THE INVENTION

It is an object of this invention to more effectively train infants to walk.

It is an additional object of this invention to more realistically simulate the walking experience.

It is yet another object of this invention to more safely train infants to walk.

FEATURES OF THE INVENTION

In keeping with these objects and others which will become apparent hereinafter, one feature of this invention resides, briefly stated, in an infant walking trainer, which comprises a handle, and body harness means suspended from the handle, and operative for supporting an infant in an upright walking stance when the handle is held overhead the infant.

In the preferred embodiment, the body harness means includes a waist strap for encircling the infant's waist, and leg straps for encircling the infant's thighs. Each leg strap has opposite ends attached to front and back portions of the waist strap. The body harness means further includes a chest strap for encircling the infant's chest, and side straps for connecting the chest and waist straps. Each of the waist and chest straps includes means for adjusting the lengths of the waist and chest straps, as well as means for opening the waist and chest straps to remove the body harness means from the infant.

The aforementioned handle is preferably elongated and has opposite handle end regions. The chest strap has a front portion and a back portion. The body harness means includes two pairs of suspension straps, each pair extending between a respective handle end and the front and back portions of the chest strap.

In accordance with this invention, the infant's legs are inserted through the leg straps, and the waist and chest straps are respectively positioned about the infant's waist and chest. The lengths of the waist and chest straps are adjusted to fit the infant. With the body harness means mounted on the infant, an adult need only grip and hold the handle overhead at an elevation sufficient to allow the infant's outstretched legs to touch the ground. The infant is thus supported in an upright walking stance. The presence of the chest strap prevents the infant from tipping forward or backward. The infant's legs and arms are unimpeded. Aided by the adult's overhead support, the infant cannot fall or propel himself or herself down staircases.

Preferably, each suspension strap has a disconnectable connector. This feature allows the handle and suspension straps to be disconnected from the chest strap, thereby allowing the infant to walk or sit without being encumbered by the handle and the suspension straps. Moreover, each suspension strap is provided with means for adjusting the length of each suspension strap to fit the height of each infant.

In accordance with another feature of this invention, each pair of suspension straps is provided with a detachable fastener, preferably a Velcro™-type fastener, for fastening together the suspension straps of each pair. Each pair of suspension straps so fastened together can therefore be conveniently folded behind the infant's back to allow the infant to continue walking.

Each strap is constituted of a reinforced webbing material, preferably nylon. The webbing material is machine washable.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
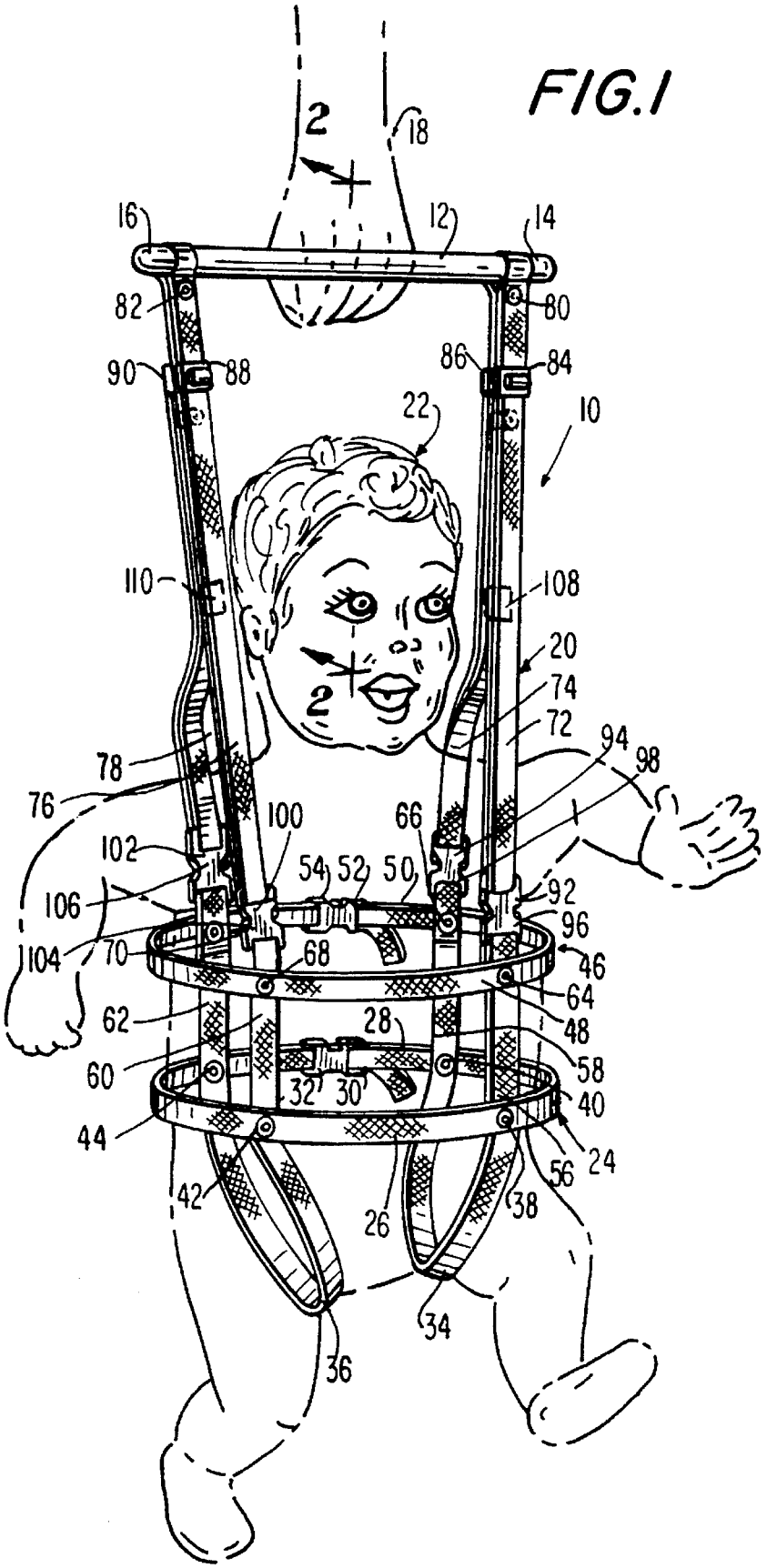
FIG. 1 is a perspective view of an infant walking trainer in use in accordance with this invention.
Figure 3:
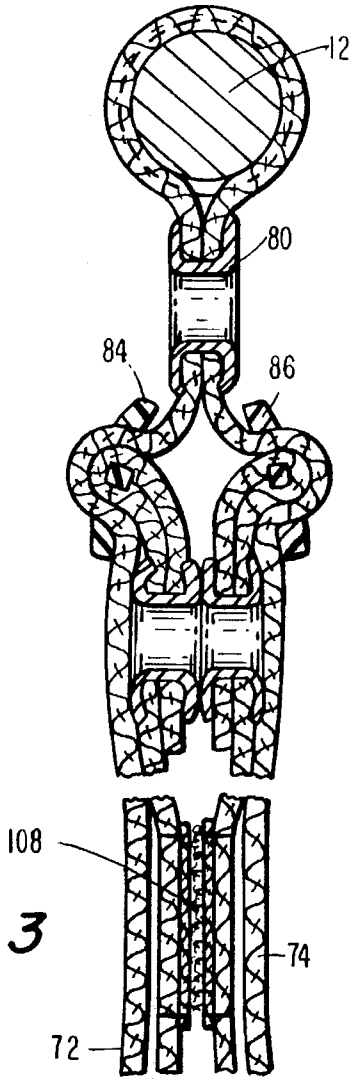
FIG. 3 is an enlarged sectional view taken on line 3—3 of FIG. 2.
Figure 2:
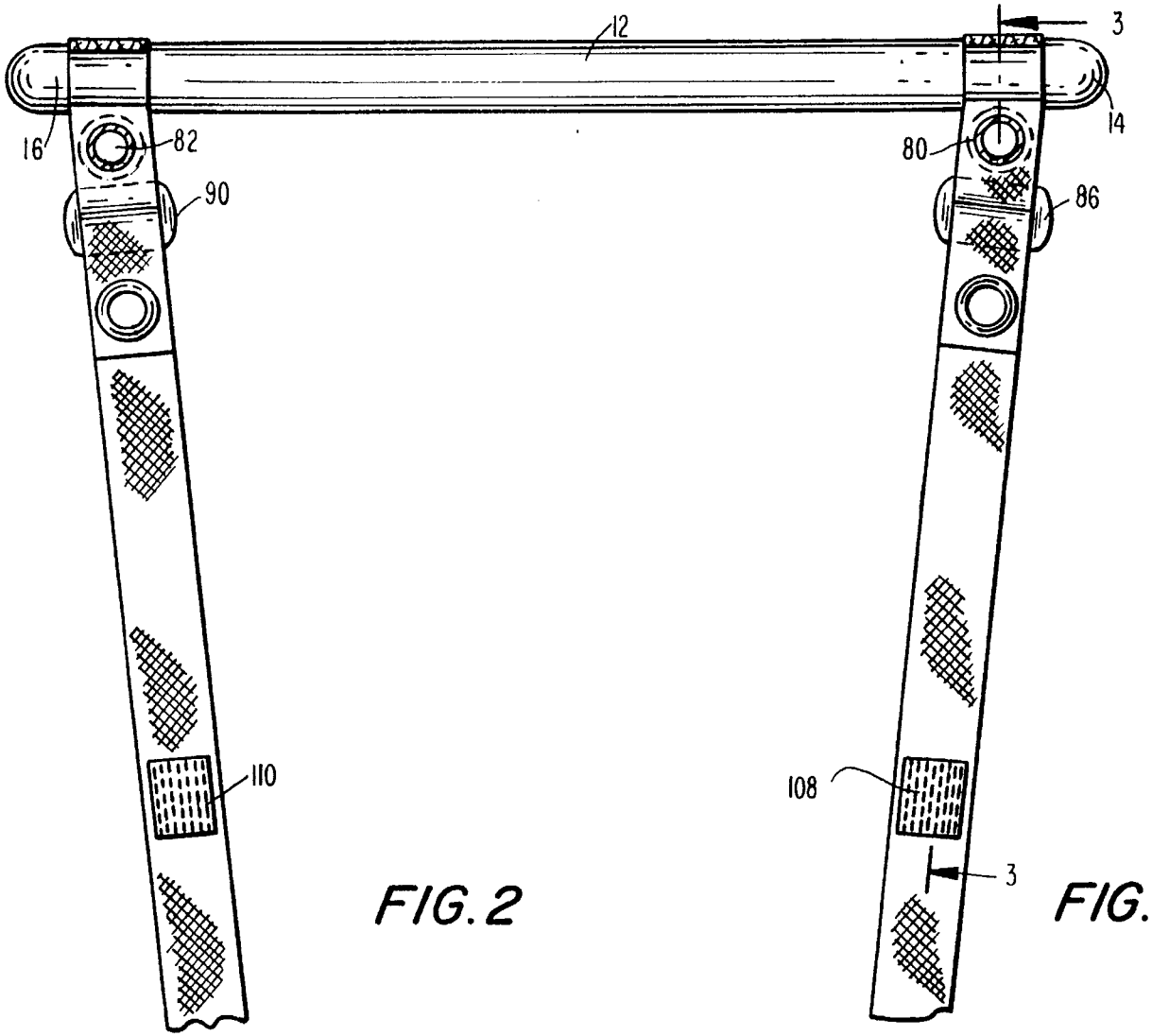
FIG. 2 is a broken-away, enlarged, front elevational view of the upper part of the trainer.

Referring now to the drawings, reference numeral 10 in FIG. 1 generally identifies an infant walking trainer according to this invention. The trainer 10 includes an elongated handle 12 having opposite handle end regions 14, 16. A body harness 20 is suspended from the handle. As explained below, an infant 22 placed within and wearing the harness 20 is supported in an upright walking stance when the handle 12 is held overhead by an adult's hand 18.

The harness 20 includes a waist strap 24 for encircling the infant's waist when worn. The waist strap 24 has a front portion 26 and a back portion 28. One end of the waist strap 24 is looped through a buckle 30 which serves to adjust the length of the waist strap 24. The opposite end of the waist strap 24 is attached to a connector 32 which couples to the buckle 30 with a snap-type action.

A pair of leg straps 34, 36 is attached to the waist strap 24. Left leg strap 34 is attached at rivets 38, 40 to the from and back portions 26, 28 of the waist strap 24, thereby forming a loop through which the infant's left leg is inserted. Right leg strap 36 is attached at rivets 42, 44 to the front and back portions 26, 28 of the waist strap 24, thereby forming a loop through which the infant's right leg is inserted.

The harness further includes a chest strap 46 for encircling the infant's chest when worn. The chest strap 46 has a front portion 48 and a back portion 50. One end of the chest strap 46 is looped through a buckle 52 which serves to adjust the length of the chest strap. The opposite end of the chest strap is attached to a connector 54 which couples to the buckle 52 with a snap-type action. Rather than a snap-type action, the connectors 32, 54 could be replaced with Velcro™-type fasteners.

A pair of left side straps 56, 58 of equal length connects the chest and waist straps at the left side of the infant. A pair of right side straps 60, 62 of equal length connects the chest and waist straps at the right side of the infant. The fight and left side straps are, in the preferred embodiment, not discrete straps, but integral extensions of the leg straps 34, 36. When worn, the chest strap 46 lies in a plane generally parallel to, and above, a plane in which the waist strap lies. The left side straps 56, 58 are connected to the chest strap at rivets 64, 66. The right side straps 60, 62 are connected to the chest strap at rivets 68, 70.

As described so far, the chest, waist, side and leg straps constitute a lower sub-assembly. The harness 20 further includes an upper sub-assembly having a left pair of left suspension straps 72, 74 extending between the handle end region 14 and the left side of the lower sub-assembly, and a right pair of right suspension straps 76, 78 extending between the opposite handle end region 16 and the right side of the lower sub-assembly. The suspension straps of each pair are connected together at rivets 80, 82 just below the handle end regions 14, 16. Each handle end region is provided with an annular channel in which the straps are seated.

Buckles 84, 86, 88 and 90 are employed to adjust the effective lengths of the suspension straps between the handle 12 and the lower sub-assembly. Straps 72, 74 terminate in connectors 92, 94 that are coupled by a snap-type action to mating connectors 96, 98 that are connected to integral extensions of the side straps 56, 58. Straps 76, 78 terminate in connectors 100, 102 that are coupled by a snap-type action to mating connectors 104, 106 that are connected to integral extensions of the side straps 60, 62. The upper sub-assembly is thus uncoupled from the lower sub-assembly by uncoupling the connectors 92, 94, 100, 102.

Intermediate the buckles 84, 86, 88 and 90 and the connectors 92, 94, 100 and 102, the harness further includes Velcro™-type hook-and loop-type fasteners 108 mounted between the straps 72, 74, and additional such fasteners 110 mounted between the suspension straps 76, 78. As described below, the fasteners 108, 110 are useful in storing the handle 12 behind the infant.

To use the trainer, the infant's legs are inserted through the leg straps 34, 36, and the waist and chest straps are strapped around the infant's waist and chest, respectively. The effective lengths of the waist and chest straps are adjusted at buckles 30, 52. The buckles 30, 52 are next snapped into place to the connectors 32, 54 behind the infant. The infant's arms are inserted through each pair of suspension straps. The effective lengths of the suspension straps are adjusted at buckles 84, 86, 88 and 90. When properly adjusted, the straps do not hinder the movement of the infant's head, legs or arms.

An adult thereupon lifts the handle with the infant supported in the harness until the infant's outstretched legs touch the floor. The infant, thus supported in an upright walking stance, is free to walk. The chest strap prevents the infant from tipping over. This stance illustrated in FIG. 1 realistically simulates actual walking.

The trainer is especially useful outdoors, as opposed to the conventional wheeled walkers that are essentially indoor devices. Also, the trainer can be used to help an infant manage stairs, buses, sidewalks, cars, etc.—a feature not possible with prior art devices.

Once the infant is able to walk by himself or herself, the adult can rest portions of the suspension straps that are held together by the Velcro™ fasteners 108, 110 on the infant's shoulders, thereby positioning the handle behind the infant. Alternatively, the upper sub-assembly can be completely detached from the lower-sub-assembly by uncoupling the connectors 96, 98, 104, 106. This feature is particularly desirable when the infant is to be seated in a carseat or highchair.

The straps are preferably made of a reinforced webbing, preferably nylon, which is machine washable. Each strap and buckle is designed to withstand at least fifty pounds of weight for safety.

It will be understood that each of the elements described above, or two or more together, also may find a useful application in other fields and types of constructions differing from the types described above. For example, rather than training infants to walk for the first time, toddlers or older infants who have been injured, or handicapped children, could be trained to walk with the trainer of this invention.

While the invention has been illustrated and described as embodied in an infant walking trainer it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An infant walking trainer, comprising:

A) an elongated handle having opposite end regions; and

B) body harness means suspended from the handle, for supporting an infant in an upright walking stance when the handle is held overhead the infant, said body harness means including i) an adjustable and closeable waist strap for encircling the infant's waist, ii) an adjustable and closeable chest strap for encircling the infant's chest, said chest strap having a front portion and a back portion, iii) side straps for connecting the chest and waist straps, iv) leg straps for encircling the infant's thighs, each leg strap having opposite ends permanently attached to the waist strap, and an intermediate looped leg portion for encircling the infant's thighs, both intermediate looped leg portions being spaced apart from and unconnected to each other, v) two left adjustable suspension straps, one left strap extending from one of the end regions of the handle directly to the front portion of the chest strap, and another left strap extending from said one of the end regions of the handle directly to the back portion of the chest strap, vi) two right adjustable suspension straps, one right strap extending from the other of the end regions of the handle to the front portion of the chest strap, and another fight strap extending frown said other end region of the handle to the back portion of the chest strap, vii) means for selectively fastening together the left suspension straps, viii) means for selectively fastening together the right suspension straps, and ix) means for selectively removing the handle from the body harness means, including a quick connect-disconnect fastener on each right and left suspension strap for disconnecting all the suspension straps and the handle from the chest strap.

* * * * *